US010370925B2

(12) United States Patent
Veldhuisen

(10) Patent No.: US 10,370,925 B2
(45) Date of Patent: Aug. 6, 2019

(54) ROD ANNULAR BLOWOUT PREVENTER HYDRAULIC SUPPLY SYSTEM

(71) Applicant: Nicholas Veldhuisen, Brandon (CA)

(72) Inventor: Nicholas Veldhuisen, Brandon (CA)

( * ) Notice: Subject to any disclaimer, the term of this patent is extended or adjusted under 35 U.S.C. 154(b) by 402 days.

(21) Appl. No.: 14/533,801

(22) Filed: Nov. 5, 2014

(65) Prior Publication Data

US 2015/0122507 A1 May 7, 2015

Related U.S. Application Data

(60) Provisional application No. 61/900,004, filed on Nov. 5, 2013.

(51) Int. Cl.
*E21B 33/06* (2006.01)
*E21B 34/16* (2006.01)

(52) U.S. Cl.
CPC ..... *E21B 33/06* (2013.01); *E21B 34/16* (2013.01)

(58) Field of Classification Search
CPC ..... E21B 33/03; E21B 33/06; E21B 33/085; E21B 34/16
See application file for complete search history.

(56) References Cited

U.S. PATENT DOCUMENTS 4,413,642 A * 11/1983 Smith ..... E21B 34/16 137/102
6,484,816 B1 11/2002 Koederitz
7,195,224 B2 3/2007 Le
2005/0029476 A1* 2/2005 Biester ..... E21B 33/0355 251/58
2008/0223467 A1* 9/2008 Tveita ..... G05D 16/2033 137/628
2012/0090893 A1* 4/2012 Leuchtenberg ..... E21B 21/08 175/25
2012/0274475 A1 11/2012 Milne
2013/0062069 A1 3/2013 Du
2013/0092385 A1* 4/2013 Curtiss, III ..... E21B 34/16 166/336

(Continued)

FOREIGN PATENT DOCUMENTS

CA 2870873 8/2018

*Primary Examiner* — David J Bagnell
*Assistant Examiner* — Yanick A Akaragwe
(74) *Attorney, Agent, or Firm* — Global Intellectual Property Agency, LLC; Daniel Boudwin

(57) ABSTRACT

A system and method for deploying a rod annular blowout preventer using existing hydraulic pressure is provided. The system connects between an existing hydraulic blowout preventer system and a blowout preventer device installed on the wellhead to provide regulated hydraulic pressure to a rod annular blowout preventer. The system comprises a manifold that receives hydraulic fluid from an existing reservoir and pump and accumulator, routes the fluid through a pressure regulator and into the rod annular blowout preventer. The rod annular blowout preventer includes a diaphragm that expands to close the wellbore during maintenance or during an emergency event. The system provides controlled hydraulic actuation of the rod annular blowout preventer, eliminates manual deployment of the rod annular blowout preventer, and allows the operator to initiate the rod annular blowout preventer away from the wellhead.

4 Claims, 1 Drawing Sheet

(56) References Cited

U.S. PATENT DOCUMENTS

| | | | | |
|---|---|---|---|---|
| 2013/0220600 | A1* | 8/2013 | Bakri | E21B 43/121<br>166/250.01 |
| 2014/0182861 | A1* | 7/2014 | Wood | E21B 21/10<br>166/373 |
| 2016/0040500 | A1* | 2/2016 | Hilpert | E21B 34/16<br>166/244.1 |

* cited by examiner

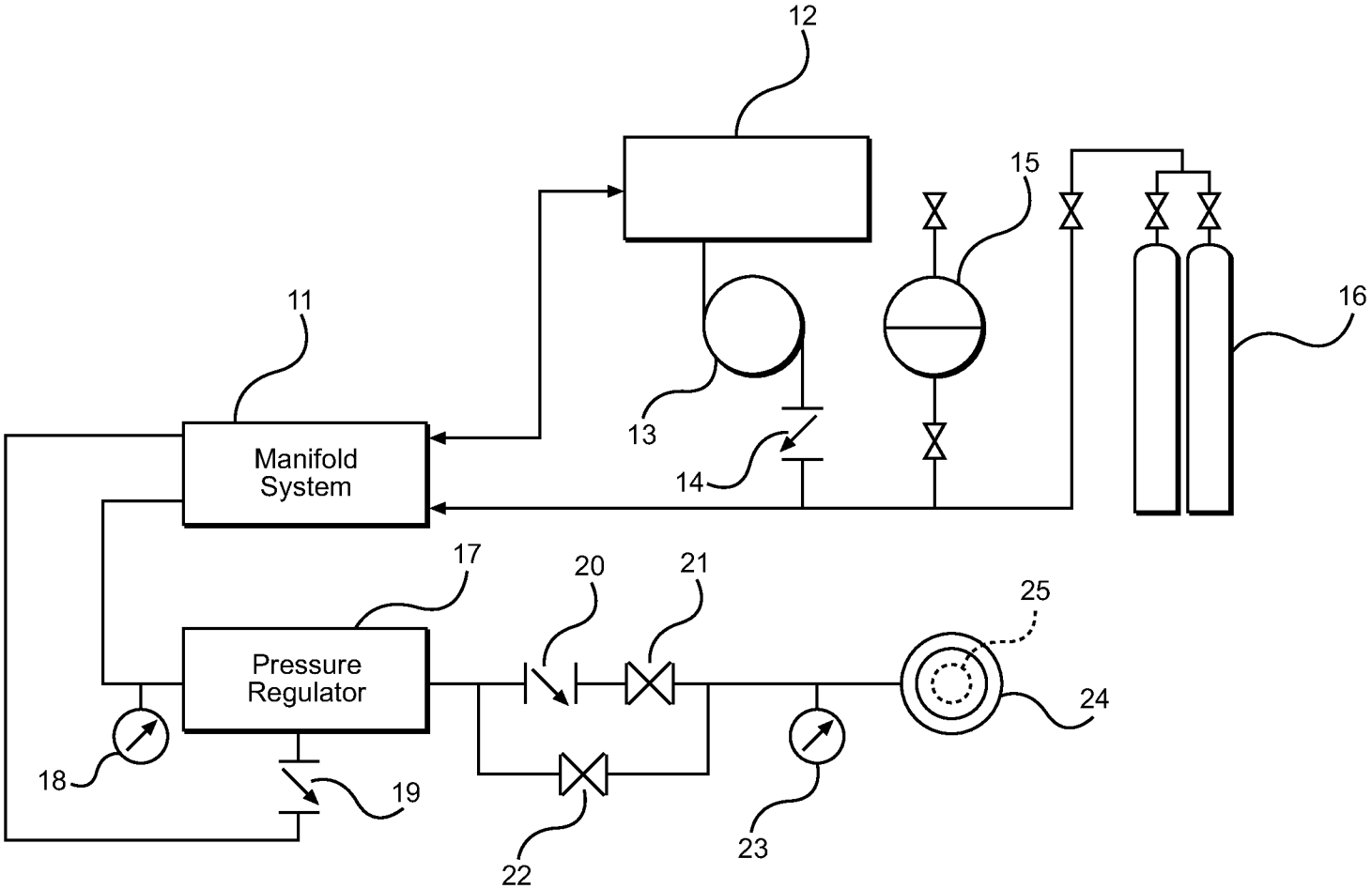
Manifold System
Pressure Regulator
11
12
13
14
15
16
17
18
19
20
21
22
23
24
25

ROD ANNULAR BLOWOUT PREVENTER HYDRAULIC SUPPLY SYSTEM

CROSS REFERENCE TO RELATED APPLICATION

This application claims the benefit of U.S. Provisional Application No. 61/900,004 filed on Nov. 5, 2013. The above identified patent application is herein incorporated by reference in its entirety to provide continuity of disclosure.

BACKGROUND OF THE INVENTION

Field of the Invention

The present invention relates to blowout preventer systems and to oil well blow out preventers. More specifically, the present invention relates to an improved system for inflating a bladder type rod blow out preventer on a well head using hydraulic pressure from the reservoir of the hydraulic pumping system.

A blowout preventer device is a required safety device on an oil rig that prevents the uncontrolled release of high pressure well fluid from an oil well. These devices are exposed to extremely high pressure, as well as erratic fluctuations in pressure. These devices are fail-safe mechanisms that prevent the escape of wellbore fluid and allow fluid to be added or removed from the wellbore as desired by operators. Additional functions include regulating and monitoring the wellbore pressure, and shutting off the well altogether in the event of an emergency or failure of the well.

Common types of blowout preventers include ram-type preventers and rod annular blowout preventers. Both of these designs allow the rods to be moved up or down through the blowout preventer device, and are used to close the annulus around the rods in the event of a blowout. Ram-type preventers require a ram block to be sized and shaped appropriately for the rods being enclosed in order to be effective when closing the well, and must be changed accordingly when installing or removing different pipes or rods in the well. Changing the blowout preventer ram based on the type of well rod being deployed is both time consuming and impractical if used as the primary blowout preventer system. Moreover, as a result of the change, the wellbore is exposed without a control device for brief periods of time. These devices may further require manual application to close off the annulus, whereby rig operators manually actuate the rams toward the rod, thereby placing workers within the vicinity of the release.

Rod annular blowout preventers enclose around a rod using an elastomeric diaphragm member, which is hydraulically activated and moved into a position that fills the gaps between the annulus and the rod cavity. The hydraulic pressure source generally employed for a rod annular blowout preventer includes hydraulic hand pumps, redirecting the hydraulic pressure supply from the rig, or redirecting pressure from a blowout preventer system. Rods include, but are not limited to, sucker rods, fiberglass rods, co-rod, sinker bars, cable, or polished rods.

These three solutions present significant safety limitations. A hand pump takes several minutes to deploy and to inflate the diaphragm, and subsequently causing loss of fluid from the well and a dangerous environment for nearby personnel. The operators are requiring to manually pump the diaphragm, placing them closer to danger for longer periods. The second alternative employs hydraulic pressure from the rig. The pressure of the rig, however, operates at extremely high levels. By contrast, the necessary closing pressure for an annular diaphragm significant less than the rig pressure. The excessive force applied by the rig hydraulic pressure therefore results in damage and premature failure of rod annular elements as a result of overpressurization. This causes failure of seals and rings, or splitting of the diaphragm upon inflation. The same issue is present when drawing hydraulic pressure from the accumulator.

The present invention contemplates a new system of deploying a rod annular blowout preventer, whereby hydraulic pressure is used from the blowout preventer system. The system employs a series of safety devices and a pressure regulator to ensure the pressure being applied to the annular diaphragm is suitable for its design. This effectively removes rig operators from dangerous situations when the blowout preventer needs to be deployed, and furthermore prevents unpredictable overpressurization of the diaphragm that may otherwise result. The system incorporates the rig manifold, allowing rig operators to operate the blowout preventer from a safe standoff distance. During normal operation, and during well servicing operations, overall safety is improved and efficiency is maximized.

Description of the Prior Art

Devices have been disclosed in the prior art that relate to hydraulic pumping systems for oil wells, as well as blowout preventers that can close in a well in the event of an emergency or during maintenance. These include devices that have been patented and published in patent application publications. These devices generally relate to improved blowout mechanisms or improved components of the overall system. The present invention contemplates an intermediate system that regulates hydraulic pressure from an existing hydraulic reservoir blowout preventer system, and operably diverts the pressure to the annual blowout preventer to rapidly deploy the same when required to do so. The present invention improves existing hydraulic application while servicing an oil well by providing an improved means of deploying a rod annular blowout preventer.

Blowout preventer systems utilize hydraulic pressure and a pump to move incompressible hydraulic fluid from a reservoir. These systems generally employ an incompressible fluid storage, such as a hydraulic fluid or the like, a prime mover (e.g. a pump) to apply pressure to the fluid, one or more accumulators, and a control station. To operate the blowout preventer device, high pressure hydraulic fluid is generated by the pump and supplemented by the accumulator of the blowout preventer system. The hydraulic fluid is retained within the one or more accumulators and routed to the blowout preventer device using a manifold system, which is a controlled series of pipes and valves that direct the fluid to the blowout preventer device during operation of the well.

During maintenance procedures and during emergency events, the blowout preventer is deployed to close the wellbore around the rod string in the well. This prevents oil leaks and surges of pressurized fluid from the well escaping through the wellhead. The present invention contemplates a system that employs a manifold control, a pressure regulator, and a series of safety features that can divert hydraulic pressure from the existing hydraulic reservoir to a rod annular blowout preventer. The pressure is regulated and thus appropriate for energizing the diaphragm of the blowout preventer, and furthermore offers rig operations with a standoff control means to initiate the blowout preventer when needed. The hydraulic pressure energizes the diaphragm into place in a matter of seconds, as opposed to manual operations that take minutes. Use of controlled pressure further ensures no failure of the blowout preventer under pressure.

It is submitted that the present invention substantially diverges in elements from the prior art, and furthermore adds a new and novel system to existing hydraulic oil well technologies that improves safety and effectiveness of rod annular blowout preventers. Lack of adequate solutions in the art make it clear that there is an unmet need. The present invention substantially fulfills this need by providing a hydraulically deployed rod annular blowout preventer without requiring additional hydraulic storage tanks or standalone systems. The present invention is one that can be installed on existing rigs with minimal interference to existing operations.

SUMMARY OF THE INVENTION

In view of the foregoing disadvantages inherent in the known types of rod annular blowout preventer systems now present in the prior art, the present invention provides a new system in which to deploy a rod annular blowout preventer using available hydraulic pressure from the blowout preventer system.

It is therefore an object of the present invention to provide a new and improved rod annular blowout preventer system that has all of the advantages of the prior art and none of the disadvantages.

It is another object of the present invention to provide a more efficient hydraulic actuation for a rod annular blowout preventer device, whereby the hydraulic pressure is drawn from the existing blowout preventer system and tailored to the specifications of the rod annular blowout preventer device deployed.

Another object of the present invention is to provide a rod annular blowout preventer system that eliminates hand pumping a rod annular blowout preventer, and furthermore prevents failure of rod annular blowout preventers as a result of overpressurization.

Yet another object of the present invention is to provide a rod annular blowout preventer system that can be deployed from a control unit on the rig or a distance therefrom, allowing rig operators to initiate the rod annular blowout preventer from a distance if required.

Another object of the present invention is to provide a rod annular blowout preventer system that includes safety valve systems to prevent well fluid from exiting the wellhead in the event the regulator fails.

Another object of the present invention is to provide a rod annular blowout preventer system that does not require an additional hydraulic reservoir or prime mover to operate, but rather capitalizes upon existing equipment and ties into the system to divert hydraulic fluid to the blowout preventer.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

FIG. 1 shows a system diagram of the system of the present invention in connection with a hydraulic blowout preventer system.

DETAILED DESCRIPTION OF THE INVENTION

Reference is made herein to the attached drawings. Like reference numerals are used throughout the drawings to depict like or similar elements of the rod annular blowout preventer system of the present invention. For the purposes of presenting a brief and clear description of the present invention, the preferred embodiment will be discussed as used for deploying the diaphragm of a rod annular blowout preventer system using hydraulic power from the existing hydraulic blowout preventer system. The figures are intended for representative purposes only and should not be considered to be limiting in any respect.

The present invention comprises a manifold control unit that is hydraulically connected to the blowout preventer system. The hydraulic fluid in the reservoir is under pressure and is controllably diverted to the rod annular blowout preventer at the wellhead using the system of the present invention. During prescribed maintenance or in the event of an emergency, rig operators can deploy the blowout preventer using the pressurized hydraulic fluid through the present system, whereby the blowout preventer is deployed in a matter of seconds, and from a distance from the wellhead itself. The present invention increases safety and all but eliminates escaping well fluid into the environment.

Referring now to FIG. 1, there is shown a system view of the present invention. The present invention comprises a manifold 11 that comprises one or more valves and hydraulic lines in connection with user controls, whereby the well hydraulic system is connected to the regulator system of the present invention. The hydraulic blowout preventer system comprises an accumulator 15, a prime mover in the form of a pump 13, and a reservoir 12 of incompressible hydraulic fluid. A nitrogen reserve 16 provides backup to the accumulator 15, whereby the accumulator provides a pressurized hydraulic fluid backup for the pump during periods of peak demand on the system. A one-way valve 14 prevents reverse flow of fluid, whereby fluid cannot enter the hydraulic pump or reservoir when the accumulator 15 and nitrogen reserve 16 are pressurized.

The hydraulic pressure of the blowout preventer system is controlled by a manifold system 11. The manifold system is a hydraulic manifold that regulates the flow of hydraulic fluid between the hydraulic inputs (e.g. the pump 13, accumulator 15, and the nitrogen reserve tanks 16) and the output of the system (namely, the blowout preventer device installed on the well). The blowout preventer device is installed on the well 24, implementing a control measure thereon while services the well or when closing the well during an emergency. The manifold system is controlled by rig operators.

The present invention contemplates integrating the hydraulic inputs of an existing blowout preventer system into a system that diverts hydraulic pressure to the wellhead blowout preventer device. To replace existing manual operations, and further to prevent overpressurization as a result of uncontrolled hydraulic actuation of the rod annular blowout preventer system, the present invention contemplates a system that can hydraulically close a blowout preventer device using a rod annular blowout preventer system with a controlled application of hydraulic pressure thereto.

Specifically, the present invention contemplates incorporation into the manifold system 11 of the existing rig, or optionally a new manifold system, that diverts hydraulic fluid pumped from the reservoir or from the accumulator 15 to the blowout preventer. A pressure regulator 17 monitors the pressure of the hydraulic fluid from the manifold 11 and prevents overly high pressure fluid from entering the blowout preventer on the wellhead 24. Fluid at a controlled pressure is directed through hydraulic lines to the blowout preventer to inflate the diaphragm 25 within the wellhead 24.

Between the pressure regulator 17 and the wellhead 24 is a series of valves for safety purposes. Fluid is forced through a one-way valve 20 and an isolation valve 21 before reaching the wellhead. The one-way valve 20 prevents backflow and the isolation valve 21 is an optional safety valve in the event the one-way valve 20 fails and backflow is being received from the wellhead 24. A pressure relief line is installed in parallel to the one-way valve 20 and the isolation valve 21. The relief line includes another isolation valve 22, which is used to release applied pressure against the rod annular blowout preventer in the well head.

Under normal conditions, pressurized hydraulic fluid from the reservoir 12 is released through the manifold system 11 and into the pressure regulator. The regulated hydraulic pressure is then routed to the rod annular blowout preventer in the wellhead, which is used to inflate or expand a diaphragm 25 therein to enclose the well around a rod string therein. Pressure can be deposited back into the reservoir 12 through a return line having a one-way valve 19 therealong, which fluidly connects the regulator 17 to the manifold when the diaphragm is expanded. Pressure in the system is monitored by pressure gauges 23, 18 along the hydraulic lines.

Overall, the present invention provides a system for closing the rod blowout preventer device. This system allows an operator to use the hydraulic pressure pumped from in the reservoir and from an accumulator to close the rod annular blowout preventer device on the wellhead. The present invention provides an efficient way to close the annular in the event of a blowout, enables an operator to safely shut in the rod annular from a remote location, and reduces the risk of blowout related risks from any exposure to wellbore fluids or gases.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hydraulic system for a rod annular blowout preventer device, comprising:

a blowout preventer system comprising:

a hydraulic fluid reservoir, a hydraulic fluid pump, and a hydraulic accumulator in fluid communication with a manifold system;

said manifold system comprising one or more valves and a user control of said one or more valves;

said manifold system receiving pressurized hydraulic fluid from said hydraulic fluid pump and said hydraulic accumulator;

a pressure regulator in fluid connection with said manifold system;

said pressure regulator configured to reduce hydraulic pressure of said pressurized hydraulic fluid from said manifold system and output said pressurized hydraulic fluid at a desired hydraulic pressure;

said pressure regulator outputting said pressurized hydraulic fluid at a desired hydraulic pressure to said rod annular blowout preventer device on a wellhead;

said pressurized hydraulic fluid at said desired hydraulic pressure activating said rod annular blowout preventer device;

a return line between said pressure regulator and said manifold system, said manifold system configured to discharge pressure to said hydraulic fluid reservoir when said rod annular blowout preventer device is in an expanded configuration;

said expanded configuration comprising a diaphragm inflated around one or more wellbore tools;

thereby regulating a reduced pressure to said rod annular blowout preventer device from a blowout preventer supply drawn from said hydraulic fluid reservoir;

said return line further comprising a one-way valve.

2. The hydraulic system for a rod annular blowout preventer device of claim 1, further comprising:

a first hydraulic line and a relief line between said pressure regulator and said rod annular blowout preventer device;

said first hydraulic line further comprising a one-way valve and a first isolation valve;

said relief line being parallel with said one way valve of said first hydraulic line and said first isolation valve;

said relief line further comprising a second isolation valve.

3. A method of activating a rod annular blowout preventer device using an existing hydraulic supply system of a blowout preventer system, comprising:

connecting pressurized hydraulic fluid from said blowout preventer system having a hydraulic fluid reservoir and a hydraulic accumulator to a manifold system using one or more hydraulic lines;

using said manifold system having one or more valves to control release of said pressurized hydraulic fluid from said manifold system;

connecting a pressure regulator in fluid connection with said manifold system;

using said pressure regulator to reduce hydraulic pressure of said pressurized hydraulic fluid from said manifold system;

directing said pressurized hydraulic fluid from said pressure regulator to said rod annular blowout preventer device on a wellhead;

using said pressurized hydraulic fluid to activate said rod annular blowout preventer device;

providing a return line between said pressure regulator and said manifold system;

using said return line and said manifold system to return pressure to said hydraulic fluid reservoir when said rod annular blowout preventer device is in an expanded configuration;

said expanded configuration comprising a diaphragm having inflated around one or more wellbore tools;

regulating a reduced pressure to said rod annular blowout preventer device from a blowout preventer supply drawn from said hydraulic fluid reservoir;

said return line further comprising a one-way valve.

4. The method of claim 3, further comprising:

placing a first hydraulic line and a relief line between said pressure regulator and said rod annular blowout preventer device;

said first hydraulic line further comprising a one-way valve and a first isolation valve;

said relief line being parallel to said one way valve of said first hydraulic line and said first isolation valve;

preventing backflow of said pressurized hydraulic fluid using said one-way valve and said first isolation valve along said first hydraulic line;

providing a second isolation valve along said relief line.

* * * * *